US008454129B2

(12) United States Patent
Kanda et al.

(10) Patent No.: US 8,454,129 B2
(45) Date of Patent: Jun. 4, 2013

(54) LIQUID EJECTION RECORDING HEAD

(75) Inventors: Toru Kanda, Oita (JP); Yuki Kozuka, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 376 days.

(21) Appl. No.: 12/484,051

(22) Filed: Jun. 12, 2009

(65) Prior Publication Data

US 2009/0309929 A1 Dec. 17, 2009

(30) Foreign Application Priority Data

Jun. 16, 2008 (JP) ..... 2008-156646

(51) Int. Cl.
*B41J 2/14* (2006.01)
*B41J 2/16* (2006.01)

(52) U.S. Cl.
USPC ..... 347/50

(58) Field of Classification Search
None
See application file for complete search history.

(56) References Cited

U.S. PATENT DOCUMENTS 6,060,770 A * 5/2000 Nakamura et al. ..... 257/668
7,115,975 B2 * 10/2006 Mori ..... 257/668
7,118,199 B2 * 10/2006 Mori ..... 347/58
2008/0143787 A1 * 6/2008 Shimazu et al. ..... 347/50

FOREIGN PATENT DOCUMENTS

JP 2004-255866 A 9/2004

* cited by examiner

*Primary Examiner* — Matthew Luu
*Assistant Examiner* — Renee I Wilson
(74) *Attorney, Agent, or Firm* — Canon USA Inc. IP Division

(57) ABSTRACT

A liquid ejection recording head includes a recording element substrate including an ejection energy generation element and a plurality of electrode pads, the ejection energy generation element being configured to generate ejection energy by which to eject a liquid, the liquid ejection recording head also includes an electric wiring substrate including a plurality of lead electrodes connected to corresponding electrode pads to apply an electric signal to the ejection energy generation element, wherein one or more of the plurality of electrode pads are not connected to any lead electrode, and each lead electrode connected to an electrode pad adjacent to any of the one or more of the plurality of electrode pads not connected to any lead electrode has a wide part whose width is greater than the width of the other lead electrodes.

4 Claims, 6 Drawing Sheets

LIQUID EJECTION RECORDING HEAD

BACKGROUND OF THE INVENTION

1. Field of the Invention

The present invention relates to a liquid ejection recording head adapted to eject a liquid such as ink thereby performing recording.

2. Description of the Related Art

In a known structure of a liquid ejection recording head, the liquid ejection recording head includes an electric wiring substrate having a lead electrode connected to a recording element substrate and also having a lead electrode (referred to as a dummy lead) that is not connected to the recording element substrate. The recording element substrate has an electrode pad for use in testing an electric function of the recording element substrate and also has an electrode pad necessary for realizing a function of the liquid ejection recording head. In general, the dummy lead is disposed at a location corresponding to a test electrode pad.

As disclosed, for example, in Japanese Patent Laid-Open No. 2004-255866, the purpose of the dummy lead is to prevent a sealing agent from sinking during a process of sealing electrodes thereby to obtain a stable shape of the electrode sealing agent. The dummy lead is not a part essential to electrical functions or functions of the liquid ejection recording head, but the dummy lead is provided on the electric wiring substrate in order to achieve the stable shape of the electrode sealing agent as described above.

In one of known configurations of such a liquid ejection recording head, the liquid ejection recording head is integrated with an ink tank for storing ink therein. To produce such a type of liquid ejection recording head, a recording element is connected to an electric wiring substrate, and the electric wiring substrate and the recording element are bonded via an adhesive to a supporting member made of a resin. In this process, a wire connection part between the electric wiring substrate and the recording element substrate, electrodes, and the peripheral part of the recording element substrate are sealed with a sealing agent. The adhesive and the sealing agent are cured by applying heat thereto.

SUMMARY OF THE INVENTION

In view of the above, the present invention provides a liquid ejection recording head.

The liquid ejection recording head includes a recording element substrate including an ejection energy generation element and a plurality of electrode pads, the ejection energy generation element being configured to generate ejection energy by which to eject a liquid, and an electric wiring substrate including a plurality of lead electrodes connected to corresponding electrode pads thereby to apply an electric signal to the ejection energy generation element, wherein one or more of the plurality of electrode pads are not connected to any lead electrode, and each lead electrode connected to an electrode pad adjacent to any of the one or more of the plurality of electrode pads not connected to any lead electrode has a wide part whose width is greater than the width of the other lead electrodes.

Further features of the present invention will become apparent from the following description of exemplary embodiments with reference to the attached drawings.

DESCRIPTION OF THE EMBODIMENTS

Figure 6:
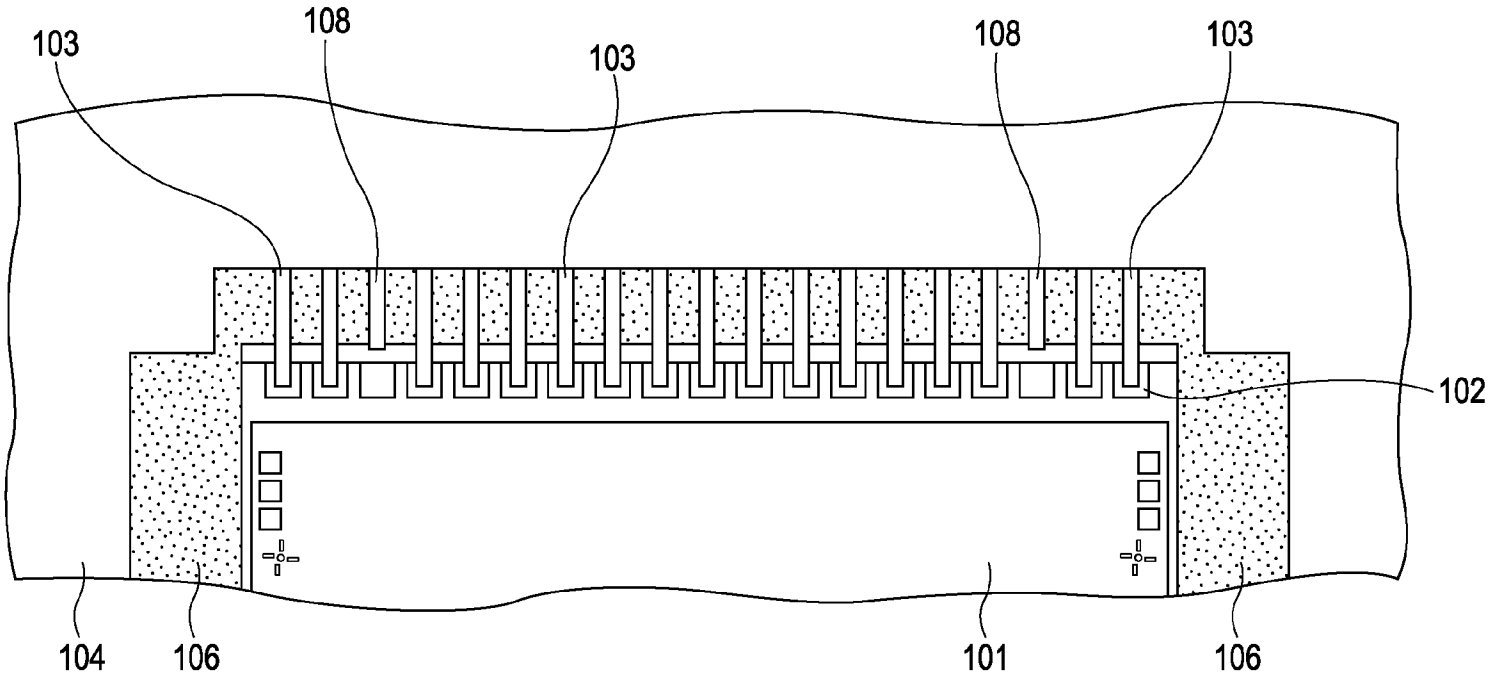
FIG. 6 PRIOR ART
FIG. 6 a plan view illustrating a structure of a part in which lead electrodes of an electric wiring substrate are connected to a recording element substrate according to a conventional technique.
Figure 7:
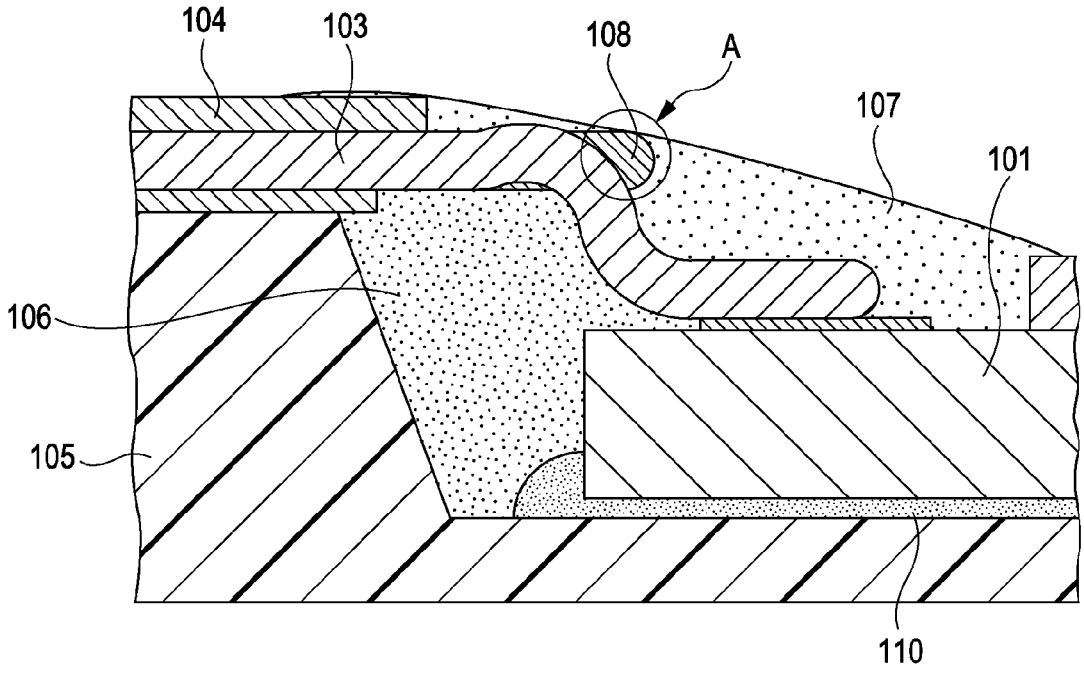
FIG. 7 PRIOR ART
FIG. 7 is a cross-sectional view illustrating in an enlarged fashion the connection part, shown in FIG. 6, in which lead electrodes of the electric wiring substrate are connected to the recording element substrate.

FIG. 6 is a plan view illustrating a structure of a connection part in which lead electrodes of an electric wiring substrate are connected to a recording element substrate according to a conventional technique. FIG. 7 is a cross-sectional view illustrating, in an enlarged fashion, a portion of the connection part shown in FIG. 6.

Heating is necessary to cure an adhesive 110 via which to bond a recording element substrate 101 to a supporting member 105 and also to cure sealing agents 106 and 107 for sealing a wire connection part and an electrode part. For this purpose, a curing process is performed using a heating furnace at a temperature of 100° C.±5° C. for a period of about 1 hour and 30 minutes. During the curing process, heating causes the supporting member 105 made of the resin to expand. As a result, the electric wiring substrate 104 bonded to the supporting member 105 expands together with the supporting member 105. Thus, the lead electrodes 103 of the electric wiring substrate 104 connected to the recording element substrate 101 are pulled, by the expansion, in a direction toward the outward of the recording element substrate 101. In view of the above, the lead electrodes 103 are connected in a bent fashion to the recording element substrate 101 so as to prevent the lead electrodes 103 from coming off the recording element substrate 101 due to pulling force created in the heating process. Therefore, the lead electrodes 103 connected to the recording element substrate 101 have a bent shape. On the other hand, the dummy leads 108 which are not connected to the recording element substrate 101 have a straight-line form extending from the electric wiring substrate 104. The lead electrodes 103 with the bent shape and the dummy leads 108 with the straight-line form are disposed so as to extend in a straight direction along an edge of an opening of the electric wiring substrate 104.

At locations adjacent to each dummy lead 108 formed in the straight-line shape, there are disposed lead electrodes 103 each having a bent part such that the end of each dummy lead 108 is located closer to the recording element substrate 101 than the bent part of the lead electrode 103 is located. That is, the end part of each dummy lead 108 protrudes beyond the location of the bent part of the lead electrode 103. The protrusion of the dummy lead 108 can be an obstacle that prevents a sealing agent 107 from properly flowing when the sealing agent 107 for sealing the electrodes is applied, which can cause the sealing agent 107 to have an unstable shape.

There is even a possibility that the end part of the dummy lead 108 is exposed to the outside via the sealing agent 107 as shown in A of FIG. 7.

One technique to prevent the exposure of the dummy lead 108 is to reduce the length of the dummy lead 108. However, the reduction in the length of the dummy lead 108 results in an increase in the distance between the recording element substrate 101 and the end of the dummy lead 108. In this case, when the sealing agent 107 is applied, the sealing agent 107 falls down into a gap between the recording element substrate 101 and the dummy lead 108 and thus a depression is created which can cause the sealing agent 107 to have an unstable shape. If such a depression is created in the sealing agent 107, a lead electrode 103 adjacent to the depression can be exposed from the sealing agent 107, and thus the creation of the depression in the sealing agent 107 can cause a reduction in reliability.

Embodiments of the present invention are described below with reference to accompanying drawings.

Figure 1:
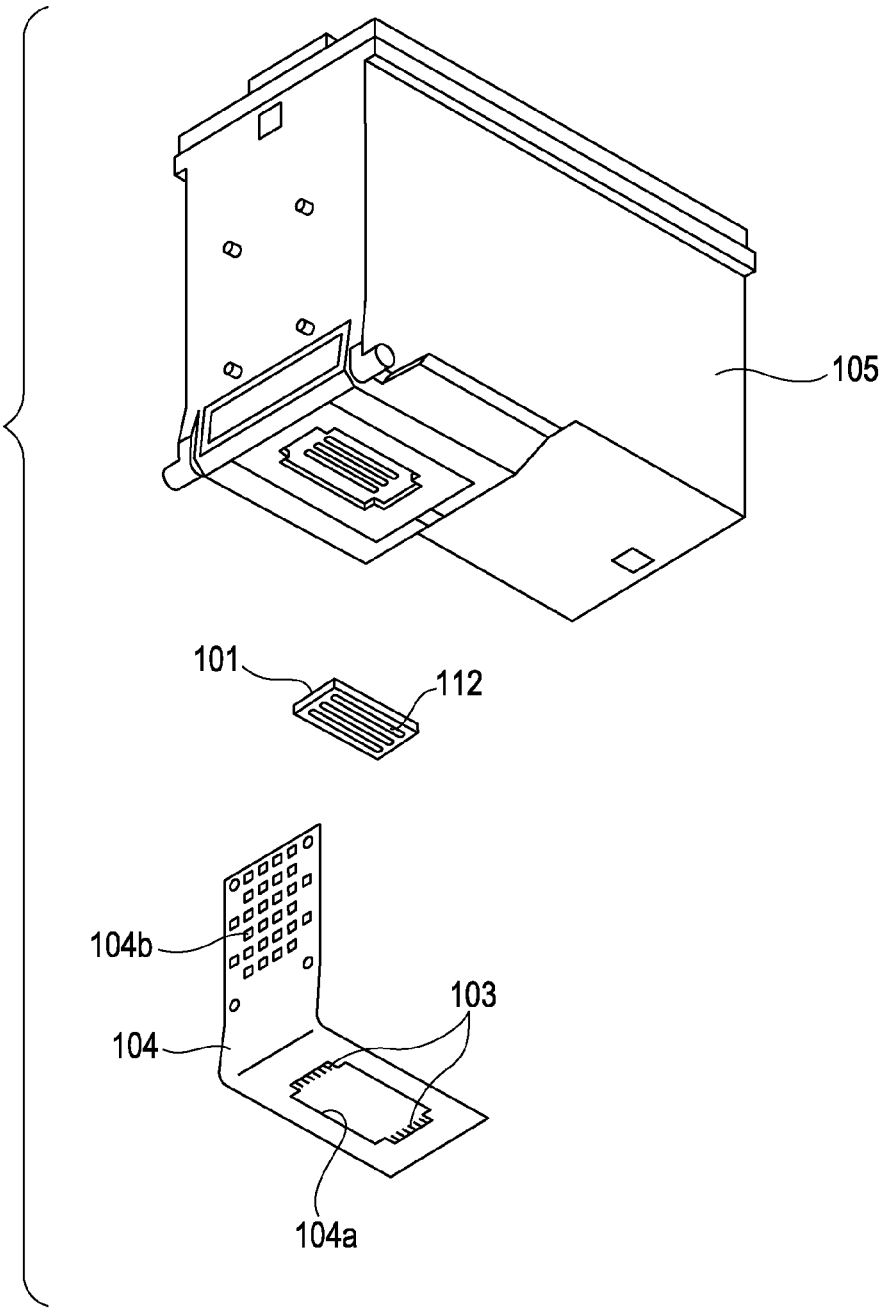
FIG. 1 is an exploded perspective view of a liquid ejection recording head according to an embodiment of the present invention.

FIG. 1 is an exploded perspective view of a liquid ejection recording head according to an embodiment of the present invention. As with the conventional liquid ejection recording head, the liquid ejection recording head according to the present embodiment of the invention also has a recording element substrate 101, an electric wiring substrate 104, and a supporting member 105.

A device hole 104*a* for disposing the recording element substrate 101 is formed in the electric wiring substrate 104. On an edge part of the device hole 104*a* of the electric wiring substrate 104, there are disposed lead electrodes 103 connected to electrode pads 102 of the recording element substrate 101 (see FIG. 2). As with the conventional lead electrodes described above with reference to FIG. 7, the lead electrodes 103 according to the present embodiment are connected in a bent form to the recording element substrate 101. The electric wiring substrate 104 has a plurality of external signal input terminals 104*b* formed thereon for receiving an electric signal from a main part of a recording apparatus in which the liquid ejection recording head is disposed. The external signal input terminals 104*b* are electrically connected to corresponding lead electrodes 103.

In the present embodiment, the supporting member 105 is formed by a resin molding process. More specifically, in the present embodiment, the resin material of the supporting member 105 is a mixture of a resin material and 35% glass filler for enhancing the rigidity of the supporting member 105.

A first embodiment of the present invention is described below with reference to accompanying drawings.

Figure 2:
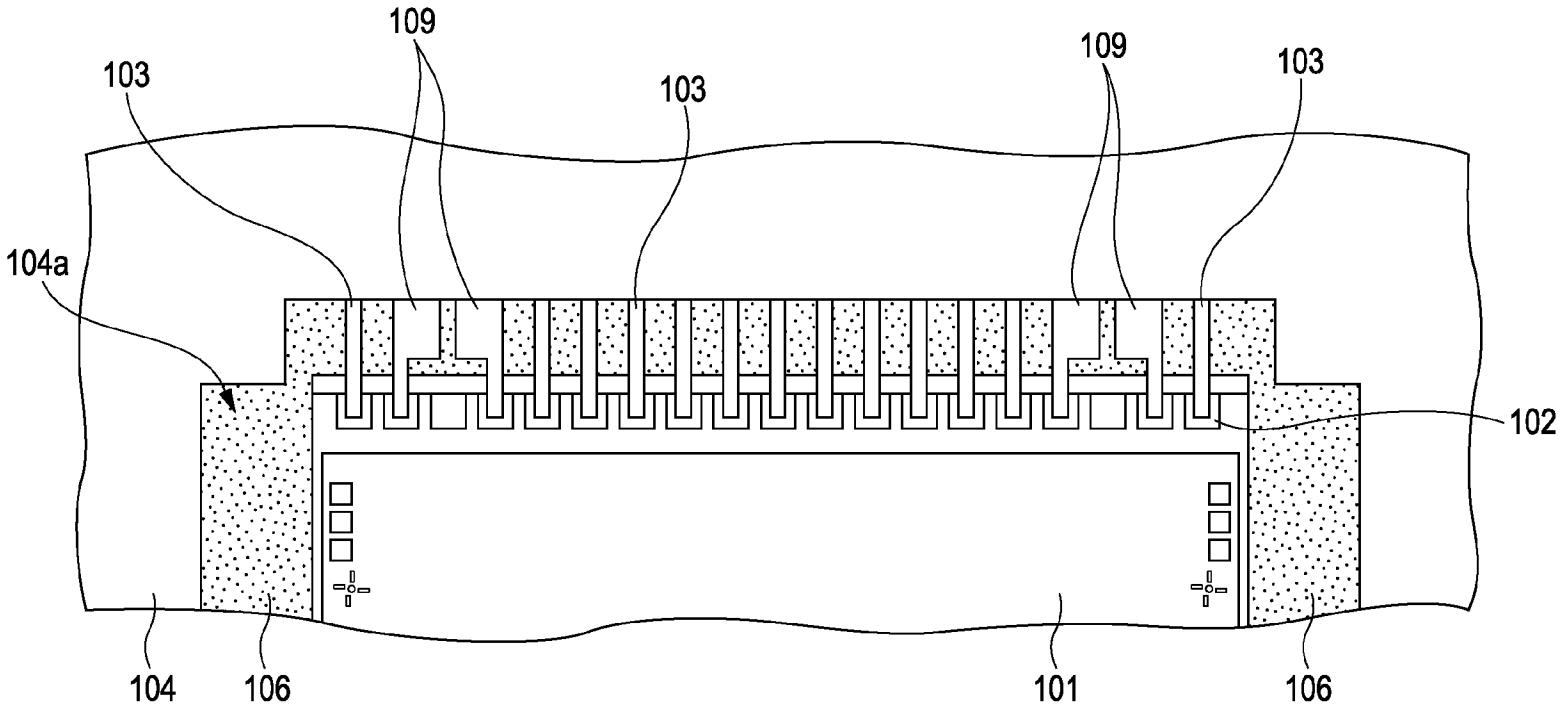
FIG. 2 is a plan view illustrating a structure of a part in which lead electrodes of an electric wiring substrate are connected to a recording element substrate according to an embodiment of the present invention.
Figure 3A:
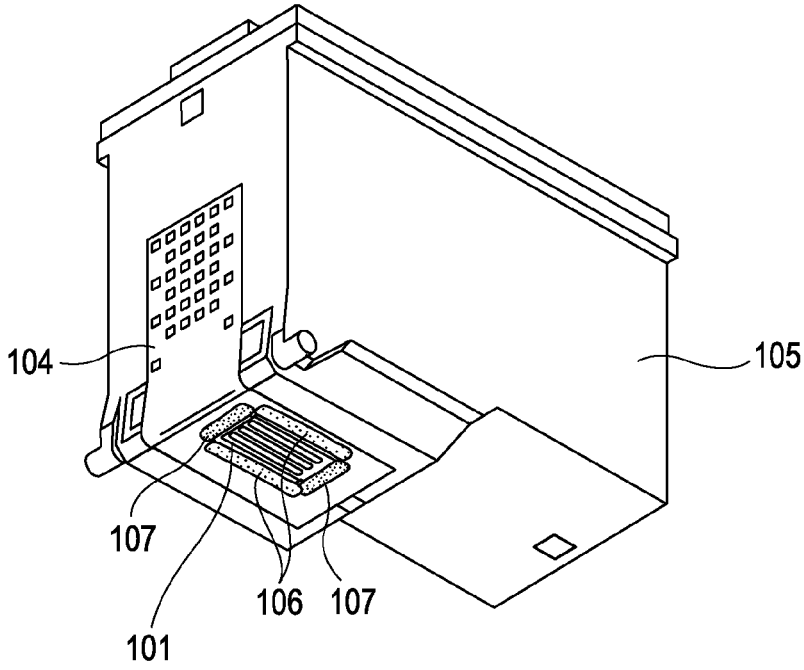
FIGS. 3A and 3B are perspective views of a liquid ejection recording head having the structure shown in FIG. 2.
Figure 3B:
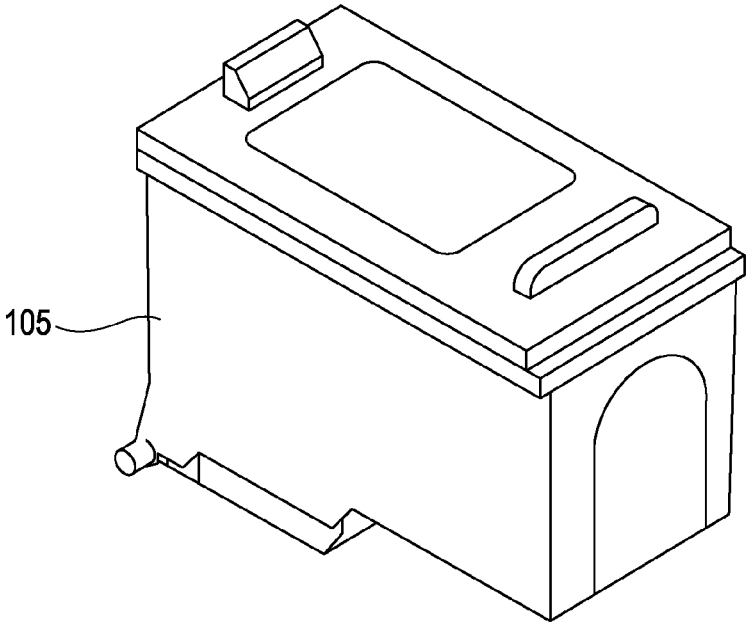
Figure 4:
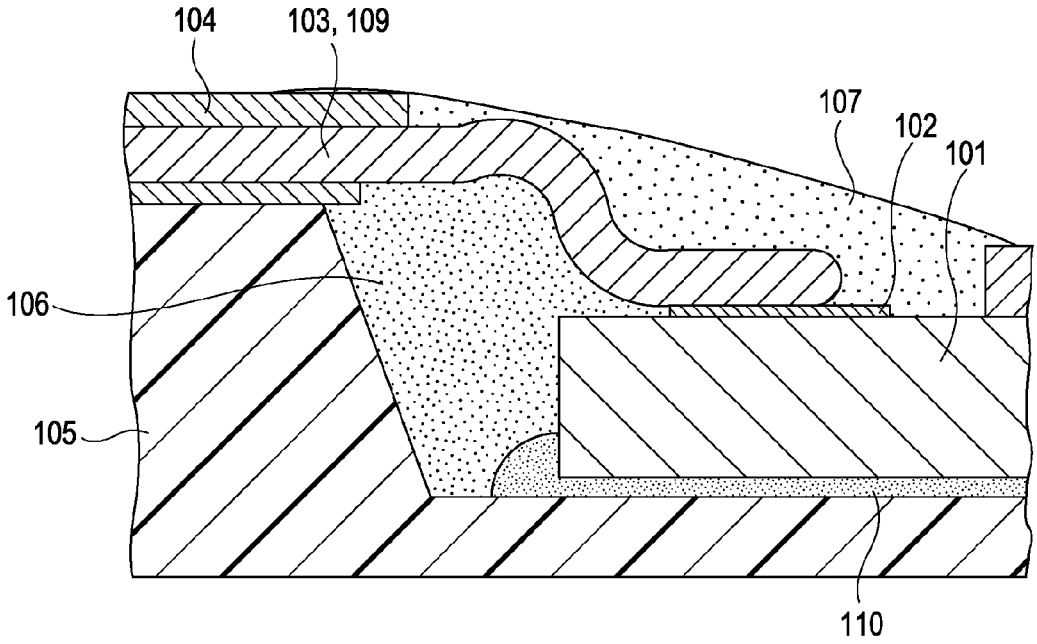
FIG. 4 is a cross-sectional view illustrating, in an enlarged fashion, the connection part shown in FIG. 2.

FIG. 2 a plan view illustrating a structure of a part in which an electric wiring substrate and a recording element substrate are connected via lead electrodes according to an embodiment of the present invention. FIGS. 3A and 3B are perspective views of a liquid ejection recording head having the structure shown in FIG. 2. FIG. 4 is a cross-sectional view illustrating, in an enlarged fashion, a portion of the connection part shown in FIG. 2.

The recording element substrate 101 has a plurality of ejection energy generation elements 112 adapted to apply ejection energy to a liquid and also has a plurality of ejection orifices (not shown) via which to eject the liquid. The recording element substrate 101 ejects a liquid via ejection orifices by pressure produced by ejection energy generated by the ejection energy generation elements. The recording element substrate 101 is firmly bonded to the supporting member 105 such that the recording element substrate 101 is supported by the supporting member 105. An electric wiring substrate 104 is electrically connected to the recording element substrate 101 and has a plurality of lead wires for transmitting electrical signals from a main part of a recording apparatus (not shown) to the recording element substrate 101. In the present embodiment, the electric wiring substrate 104 is a flexible wiring substrate using a TAB (Tape Automated Bonding) technique. A periphery sealing agent 106 is a sealing agent applied to the periphery of the recording element substrate 101 and to the electric connection part between the recording element substrate 101 and the electric wiring substrate 104 so that the periphery of the recording element substrate 101 and the electric connection part between the recording element substrate 101 and the electric wiring substrate 104 are protected by the periphery sealing agent 106 from corrosion by a liquid and from being short-circuited. An electrode sealing agent 107 is a sealing agent disposed for protecting the electric connection part between electrode pads 102 formed on the recording element substrate 101 and the lead electrodes 103 of the electric wiring substrate 104 from external force such as wiping force, corrosion by a liquid, a short-circuit failure, etc.

A device hole 104*a* is formed in the electric wiring substrate 104 such that the recording element substrate 101 is exposed via the device hole 104*a*, and a plurality of lead electrodes 103 and 109 are disposed at properly selected intervals in the device hole 104*a*. The lead electrodes are connected to corresponding electrode pads 102 so that an electric signal can be applied to the ejection energy generation element on the recording element substrate 101.

As can be seen from FIG. 4, the electrode sealing agent 107 is disposed in such a manner as to cover the whole area including the electric connection part where the electrode pads 102 of the recording element substrate 101 are connected to the lead electrodes 103 and 109 of the electric wiring substrate 104. The periphery sealing agent 106 is disposed in the periphery of the recording element substrate 101 such that the whole region below the lead electrodes 103 and 109 is filled with the periphery sealing agent 106 by capillarity. In regions between adjacent lead electrodes 103 or 109, the surface tension of the periphery sealing agent 106 allows the periphery sealing agent 106 to be raised to a height corresponding to the lead electrodes 103 or 109. In each region between adjacent lead electrodes 103 or 109, the weight of the periphery sealing agent 106 causes the periphery sealing agent 106 to slightly sink and thus a depression with a lowest point at its center is created in each such region. The periphery sealing agent 106 formed in the above-described manner is in contact with the electrode sealing agent 107 applied over the periphery sealing agent 106.

In the present embodiment, one or more of the electrode pads 102 are not connected to any lead electrode. An example of such an electrode pad with no connection to lead electrodes is a test pad used in testing an electric function of the recording element substrate. A lead electrode 109 connected to an electrode pad 102 adjacent to the electrode pad 102 that is not connected to any lead electrode has a wide part whose width is greater than the width of the other lead electrodes 103. The area of a gap formed between adjacent two wide lead electrodes 109 is substantially equal to the area of a gap formed between two normal lead electrodes 103. That is, the gap between any two adjacent lead electrodes is equal in area. This allows the periphery sealing agent 106 to sink by a substantially equal amount between adjacent lead electrodes 103 or 109, and thus the electrode sealing agent 107 disposed on the periphery sealing agent 106 is substantially equally held by the lead electrodes 103 and 109. In other words, it becomes possible to apply the electrode sealing agent 107 substantially uniformly over a specified sealing area.

The lead-to-lead pitch of lead electrodes 103 and 109 may be set within a predetermined range. More specifically, the minimum lead-to-lead pitch may be set to a value that does not cause two adjacent lead electrodes 103 or 109 to be short-circuited, while the maximum lead-to-lead pitch may be set to a value that does not cause the periphery sealing agent 106 to sink in a region between adjacent lead electrodes by an amount greater than an allowable limit. In the present embodiment, the lead-to-lead pitch of the lead electrodes 103 and 109 is set within the range from 40 μm to 100 μm.

Furthermore, in the present embodiment, the bent part of each lead electrode 109 is formed to be wider than the other parts, while the end part thereof connected to one of the electrode pads 102 of the recording element substrate 101 is narrower than the bent part and the electrode pad 102. The greater width of the bent part of each lead electrode allows the lead electrode to bend in a stable manner in the bent part, and thus it is possible to achieve a stable shape of the electrode sealing agent 107. If the end part of the lead electrode 109 is greater in width than the electrode pad 103, the end part of the lead electrode 109 can come into contact with a lead wire located close to the electrode pad 102 on the recording element substrate 101, which can cause the lead wire to be damaged, which in turn can cause a short circuit to occur between lead wires on the recording element substrate 101. In view of the above, the end part of each lead electrode 109 has a narrow part whose width is smaller than the width of the electrode pad 102. Note that the width of each lead electrode 109 in an area on the electric wiring substrate 104 is smaller than the width of the bent part. This makes it possible to achieve a high density arrangement of lead wires on the electric wiring substrate, and thus it becomes possible to achieve a size reduction of electric wiring members. A dummy lead not connected to the electrode pad 102 might be applied to the first embodiment of the invention as long as the electrode sealing agent 107 maintains its uniformity substantially. In this liquid ejection recording head according to the first embodiment of the present invention, the sealing agent has a stable shape and thus improves reliability.

Figure 5:
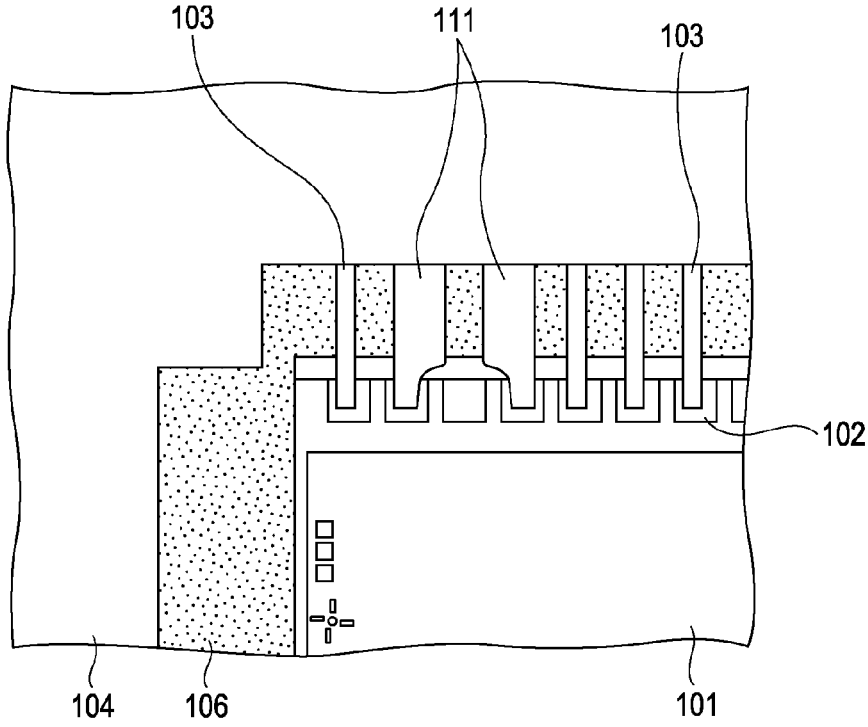
FIG. 5 is a diagram illustrating another embodiment of the present invention.

A second embodiment of the present invention is described below with reference to FIG. 5.

Also in this second embodiment, a lead electrode 111 connected to an electrode pad 102 adjacent to an electrode pad that is not connected to any lead electrode is wider than the other lead electrodes 103. The bent part of each lead electrode 111 is formed to be wider than the other parts, while the end part thereof connected to one of the electrode pads 102 is narrower than the bent part and the electrode pad 102. In the present embodiment, unlike the previous embodiment, the width of the lead electrode 111 gradually changes between the wide bent part and the narrow end part. The lead electrode 111 has a tapered width part formed between the wide bent part and the narrow end part.

By forming each lead electrode 111 so as to gradually change in width in the boundary region, it becomes possible to disperse the bending stress, which would otherwise be concentrated on the boundary region, over the bent part of the lead electrode 111. Thus, it becomes possible to obtain the bent part having a desirable smooth shape. This allows the electrode sealing agent 107 to be formed in a still more stable shape. Furthermore, in the present embodiment, the wide part of the lead electrode 111 extends to a location close to the electrode pad 102 so that the whole bent part is included in the wide part. This makes it possible to more surely prevent the lead electrode 111 from being partially exposed from the electrode sealing agent 107. The gap between two adjacent wide lead electrodes 111 is substantially equal in size to the gap between two normal lead electrodes 103. This makes it possible to form the periphery sealing agent 106 and the electrode sealing agent 107 so as to be uniform in the lead arrangement direction.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-156646 filed Jun. 16, 2008, which is hereby incorporated by reference herein in its entirety.

What is claimed is:

1. A liquid ejection recording head comprising:

a recording element substrate including an ejection energy generation element and a plurality of electrode pads, the ejection energy generation element being configured to generate ejection energy by which to eject a liquid; and an electric wiring substrate including a plurality of lead electrodes connected to corresponding electrode pads to apply an electric signal to the ejection energy generation element, wherein one or more of the plurality of electrode pads are not connected to any lead electrode, and the plurality of lead electrodes include first lead electrodes, each of which being connected to each of electrode pads located at both sides of an electrode pad of the one or more of the plurality of electrode pads not connected to any lead electrode, and wherein each of the first lead electrodes has a wide part whose width is greater than the width of the other lead electrodes and has a narrow part that is directly connected to the electrode pad, the narrow part whose width is smaller than the wide part.

2. The liquid ejection recording head according to claim 1, wherein a gap having an equal area is formed between each two adjacent lead electrodes.

3. The liquid ejection recording head according to claim 1, wherein the first lead electrodes have a tapered width part formed between the wide part and the narrow part.

4. The liquid ejection recording head according to claim 1, wherein with regard to an arrangement direction of the plurality of lead electrodes, each of the first lead electrodes has the wide part protruding toward a side of the electrode pad of the one or more of the plurality of electrode pads not connected to any lead electrode, and has a straight shape for another side of the electrode pad of the one or more of the plurality of electrode pads not connected to any lead electrode.

* * * * *